United States Patent [19]

McEdwards

[11] 4,325,199

[45] Apr. 20, 1982

[54] ENGINE SOUND SIMULATOR

[76] Inventor: Timothy K. McEdwards, 1000 W. MacArthur Blvd., Apt. 31, Santa Ana, Calif. 92707

[21] Appl. No.: 196,840

[22] Filed: Oct. 14, 1980

[51] Int. Cl.[3] ..... A63H 33/26

[52] U.S. Cl. ..... 46/232; 46/254; 340/32

[58] Field of Search ..... 46/232, 227, 251, 253, 46/254, 257, 111, 112; 455/238, 355, 33; 340/323 R, 32, 33; 273/86 B

[56] References Cited

U.S. PATENT DOCUMENTS

| | | | |
|---|---|---|---|
| 3,233,362 | 2/1966 | Chapman | 46/227 |
| 3,425,156 | 2/1969 | Field | 46/232 |
| 3,466,797 | 9/1969 | Hellsund | 46/232 |
| 3,510,631 | 5/1970 | Weinberg et al. | 235/92 |
| 3,588,869 | 6/1971 | Clift | 340/323 |
| 4,219,962 | 9/1980 | Dankman et al. | 46/232 |
| 4,238,778 | 12/1980 | Ohsumi | 340/33 |

*Primary Examiner*—Robert Peshock
*Assistant Examiner*—Mickey Yu
*Attorney, Agent, or Firm*—Burd, Bartz & Gutenkauf

[57] ABSTRACT

A remote controlled car driven by an electric motor energized with a battery has an internal combustion engine sound simulator that transmits signals to one or more remote receivers having audio outputs that simulate an internal combustion engine driving the car. The engine sound simulating apparatus has a digital switch sensor responsive to the speed of rotation of the drive wheel of the vehicle for producing an output signal. A signal converting circuit receives the output signal from the digital switch sensor and provides a signal having a frequency that changes in response to ranges of speed of the car. A transmitter means connected to the signal converting circuit transmits the signals to the remote located receivers. The receivers have speakers for producing an audible output simulating the operation of an internal combustion engine.

24 Claims, 7 Drawing Figures

Fig. 1A
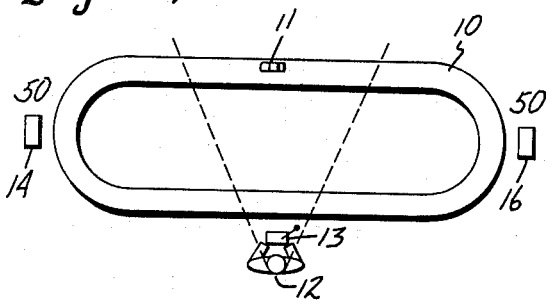
Fig. 1B
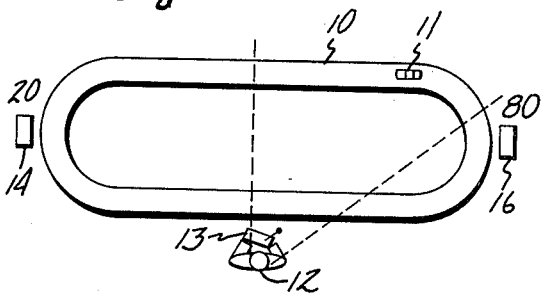
Fig. 1C
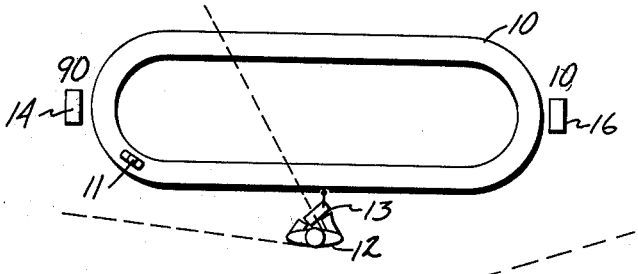
Fig. 2
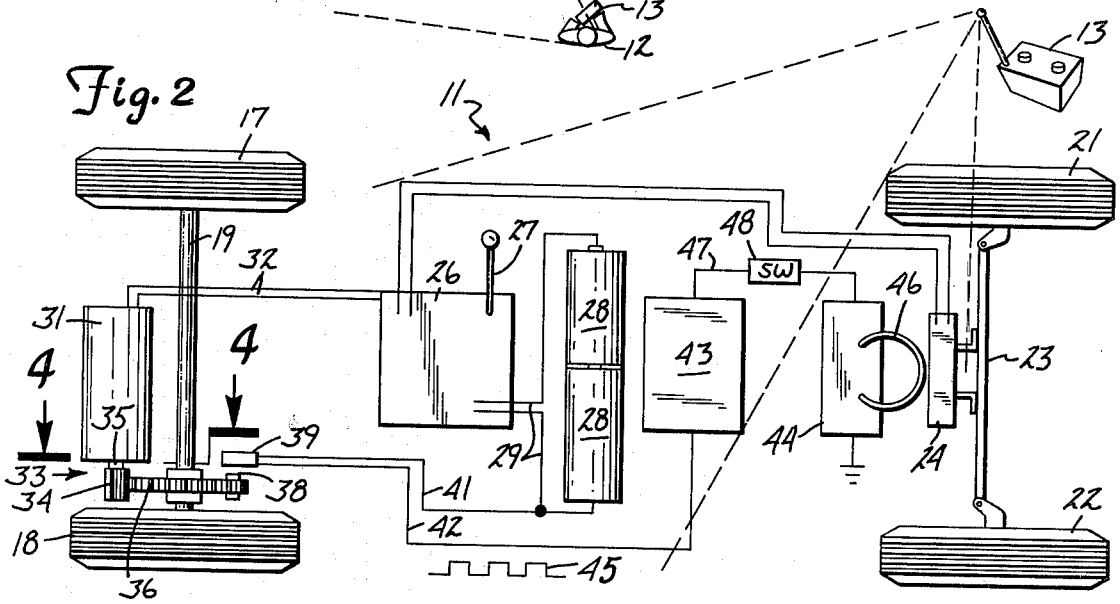
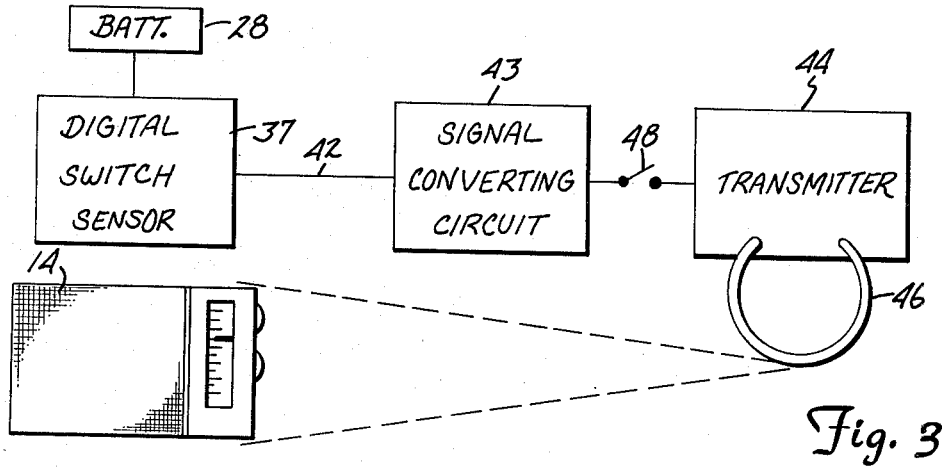
Fig. 3

ENGINE SOUND SIMULATOR

SUMMARY OF INVENTION

The invention is related to an engine sound simulator for an electric motor driven vehicle, such as a car, truck, tractor, locomotive, and the like. Radio controlled, R/C, products include a large variety of vehicles, such as scale model cars, trucks, tractors, off-road and amphibious vehicles, helicopters, boats, aircraft, and remote controlled robots. These products are operated with battery powered electric motors which produce very little noise. The consumer wants R/C products that are seen and heard in the street. An engine sound simulator associated with a racing vehicle enhances racing realism and excitement. The driver of the model race vehicle having an engine sound simulator has a sensory input pertaining to the speed. Internal combustion engine sound simulating devices have been mounted directly on the vehicles. An example of an engine sound simulator is shown by Field in U.S. Pat. No. 3,425,156.

The engine sound simulator of the invention is incorporated in an electric motor driven vehicle of the remote control type. The vehicle has an electric motor drivably coupled to at least one drive wheel. Power transmitting means connect the drive wheel to the electric motor so that on operation of the electric motor the wheel rotates to move the vehicle on a support surface of a track. The track can be a continuous or endless track. Located in selected locations around the track are receivers, such as AM/FM radios having speakers providing an audio output that simulates the operation of an internal combustion engine powering the vehicle. The isolated receivers provide for an easily adjustable and potentially unlimited volume level to achieve appropriate sound levels for indoor and outdoor use. Several different vehicles are able to utilize the same receiver simultaneously by tuning the transmitters on the vehicles to the same operating frequency. Localization of the sound source is realized when only one receiver is utilized. A plurality of receivers located about the track operates to automatically adjust their respective sound levels in accordance with the vehicle's relative position relative to the receiver. The observer mixes the various sound levels coming from each receiver and experiences the illusion of stereo imaging which is coordinated with the visual observation of the vehicle moving around the track.

The engine sound simulator has a digital switch sensor means responsive to the speed of operation of the electric motor driving the vehicle for producing an output signal having a frequency proportional to the speed of the vehicle. The digital switch sensor means includes a magnet means that is rotated by operation of the electric motor and a sensor element operable to provide an output signal each time the magnet means passes adjacent the sensor element. A signal converting means receives the output signals from the sensor element and converts the signal to a signal having a frequency that changes in response to ranges of speed of the vehicle. The signal converting means includes a plurality of comparators and multi-vibrator coupled to the comparators. Each of the comparators is responsive to a separate frequency range of the output signal derived from the digital switch sensor means to alter the output frequency of the multi-vibrator to simulate different speed changes of the internal combustion engine.

Transmitter means mounted on the vehicle is connected to the signal converting means for transmitting signals from the signal converting means to the remote receivers located about the track. The receivers have speakers which provide audio output simulating the operation of the engine, such as an internal combustion engine, used to drive the vehicle about the track.

An object of the invention is to provide a radio controlled (R/C) vehicle with an audio system operable to attain a realistic simulation of the operation of an internal combustion engine. A further object of the invention is to provide an electric motor driven R/C car with an internal combustion engine audio simulator that has no mechanical or electrical drag, has only a negligible power drain on the existing batteries of the car, and does not appreciably add to the total weight of the car. The engine audio simulator is versatile in use, as it is compatible to the large number of the performance electric motor driven cars. The simulator has an engine audio simulation circuit that can be incorporated into existing and new electric motor driven cars at a relatively small cost with a minimum of time and labor, as there is no extensive machining or tooling required to incorporate the circuit to a car. The engine simulation audio system is reliable in use, as there are no moving or delicate parts which need periodic adjustment or replacement. The engine simulation audio system has a wide range of audio volume levels and is compatible with an AM/FM radio used for the sound generation. The simulator can be adapted to all types of R/C vehicles, including land vehicles, trains, boats, and aircraft.

IN THE DRAWINGS

FIGS. 1A, 1B, and 1C are diagrammatic views of an oval model race car track and audio transmitters at opposite ends of the track for providing simulated engine sound of a model race car moving around the track;

FIG. 2 is a diagrammatic view of a model electric performance race car provided with the engine sound simulator of the invention;

FIG. 3 is a block diagram of the engine sound simulator;

DESCRIPTION OF PREFERRED EMBODIMENT

Figure 4:
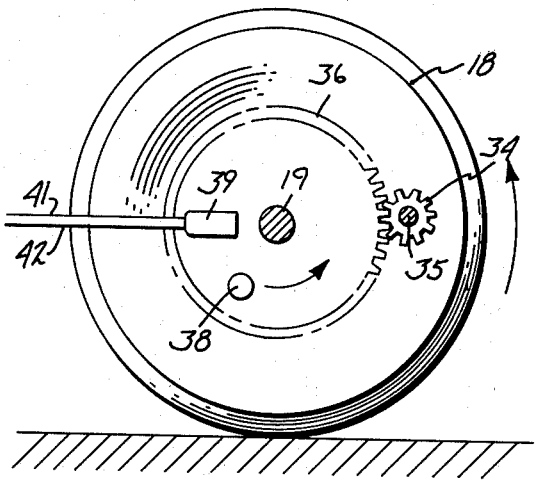
FIG. 4 is an enlarged sectional view taken along the line 4—4 of FIG. 2.

Referring to FIGS. 1A, 1B, and 1C, there is shown a radio controlled (R/C) typical model car race track 10 having an elongated oval surface for supporting one or more electric motor operated R/C race cars 11. One or more observers 17 located adjacent the side of track 10 normally watch the racing of car 11 on track 10. Observer 12 has a remote radio control box 13 operable to signal control apparatus carried by car 11 to alter the speed and steer car 11 on track 10. Control box 13 has a number of hand operated actuators, such as levers and a steering wheel, that are used to control the functions of car 11. The following description is directed to a scale performance R/C racing car, such as a Ferrari boxer or a BMW Deluxe racer. The engine noise simulator of the invention can be used with all types of model R/C vehicles, including, but not limited to, four-wheel drive vehicles, pickup trucks, tractors, motorcycles, power boats, airplanes, and railroad engines. The engine, which is audibly simulated, can be an internal combustion engine, jet engine, steam engine, or Wankel engine.

The engine sound simulator of the invention is used with R/C car 11 driven on track 10 to provide an audio output or sound that simulates an operating internal combustion engine. The engine sound simulator includes receivers or receiver-speaker units 14 and 16 located adjacent opposite ends of track 10. The receiver-speaker units 14 and 16 can be radios tuned to the frequency of a transmitter carried by car 11.

As R/C car 11 maneuvers around track 10, its distance relative to the receiver-speaker units 14 and 16 is constantly changing. Car 11 will move nearer one receiver-speaker unit, while moving away from the opposite receiver-speaker unit. The audio outputs of receiver-speaker units 14 and 16 are in direct relationship to the distance car 11 is from each receiver-speaker unit, as 50—50 in FIG. 1A and 20–80 in FIG. 1B. Observer 12 mixes the audio signals and levels of signals coming from each receiver-speaker unit 14 and 16 and experiences an illusion of stereo-imaging of an internal combustion engine powering car 11 around track 10. Additional receiver-speaker units can be placed around track 10 to provide a more complete illusion of stereo-imaging.

R/C car 11 has a pair of rear drive wheels 17 and 18 secured to a transverse drive shaft 19. Drive shaft 19 is rotatably supported in a conventional manner on the frame (not shown) of car 11. The frame can be a metal plate extended horizontally between the front and rear wheels of the car. The front of the car frame rotatably supports front wheels 21 and 22 which are connected with a steering tie rod 23. A steering control unit 24 connected to tie rod 23 is operable to move tie rod 23 and thereby steer car 11. Steering control unit 24 has suitable electronic components that are connected to control means 26 having an electrical circuit coupled to an antenna 27. Tie rod 23 can be connected with levers and links to a movable member of control means 26 in the usual manner.

The control means has a board accommodating control circuit 26 operatively coupled to an antenna 27 for receiving control signals emanating from remote control box 13. Control circuit 26 is connected with lines 29 to a power source, such as one or more D.C. batteries 28. The output of control circuit 26 is carried via lines 32 to an electric drive motor 31 mounted on the frame between drive wheels 17 and 18. Drive motor 31 is drivably connected to drive shaft 19 with a mechanical power transmission indicated generally at 33. Power transmission 33 has a small drive gear 34 fixed to motor drive shaft 35. Gear 34 is located in driving engagement with the teeth of a large driven gear 36. Driven gear 36 is secured to shaft 19 adjacent the inside of wheel 18. Electric motor 31 is a high speed D.C. motor. The speed of motor 31 is varied by the current supplied thereto which is controlled by the operation of control circuit 26. Motor 31 via power transmission 33 drives wheels 17 and 18 thereby causing car 11 to move along track 10.

The engine sound simulator includes switch means indicated generally at 37 operable to provide a pulsating electric signal directly related to the speed of car 11. Switch means 37 is a Hall-Effect digital switch triggered by one or more permanent magnets 38 mounted on gear 36 and rotatable therewith about the axis of drive shaft 19. A sensor 39 responsive to the magnet force of magnet 38 is mounted on the car frame adjacent the path of movement of magnet 38. Sensor 39 is connected with a line 41 to battery 28 and a line 42 to a signal converting circuit unit indicated generally at 43. As magnet 38 passes adjacent the sensitive side of sensor 39, a pulsating electric signal 45 is generated by sensor 39. This pulsating electric signal is transmitted via line 42 to signal converting circuit 43. Signal 45 varies in frequency in direct relationship to the rpm of gear 36 and, thus, the speed of car 11.

Signal converting circuit unit 43 is connected to a signal transmitter 44 having a loop antenna 46. Line 47 containing an on-off switch 48 electrically couples circuit 43 to transmitter 44. Switch 48 can be manually turned off to disconnect transmitter 44 from circuit 43. When switch 48 is on, transmitter 44 transmits radio signals via antenna 46 to receiver-speaker units 14 and 16 which have audio outputs that simulate the operation of an internal combustion engine. The audio output will simulate the upshifting of the engine, as well as the downshifting of the engine.

Now that the physical layout of the sound simulator has been explained with the aid of FIG. 2, and the electrical relationship of the components has been explained with the aid of the block diagram of FIG. 3, consideration will next be given to the details of the implementation of the signal converting circuit 43 and the transmitter 44 and, in this regard, reference will be made to the electrical schematic diagram of FIG. 5.

Figure 5:
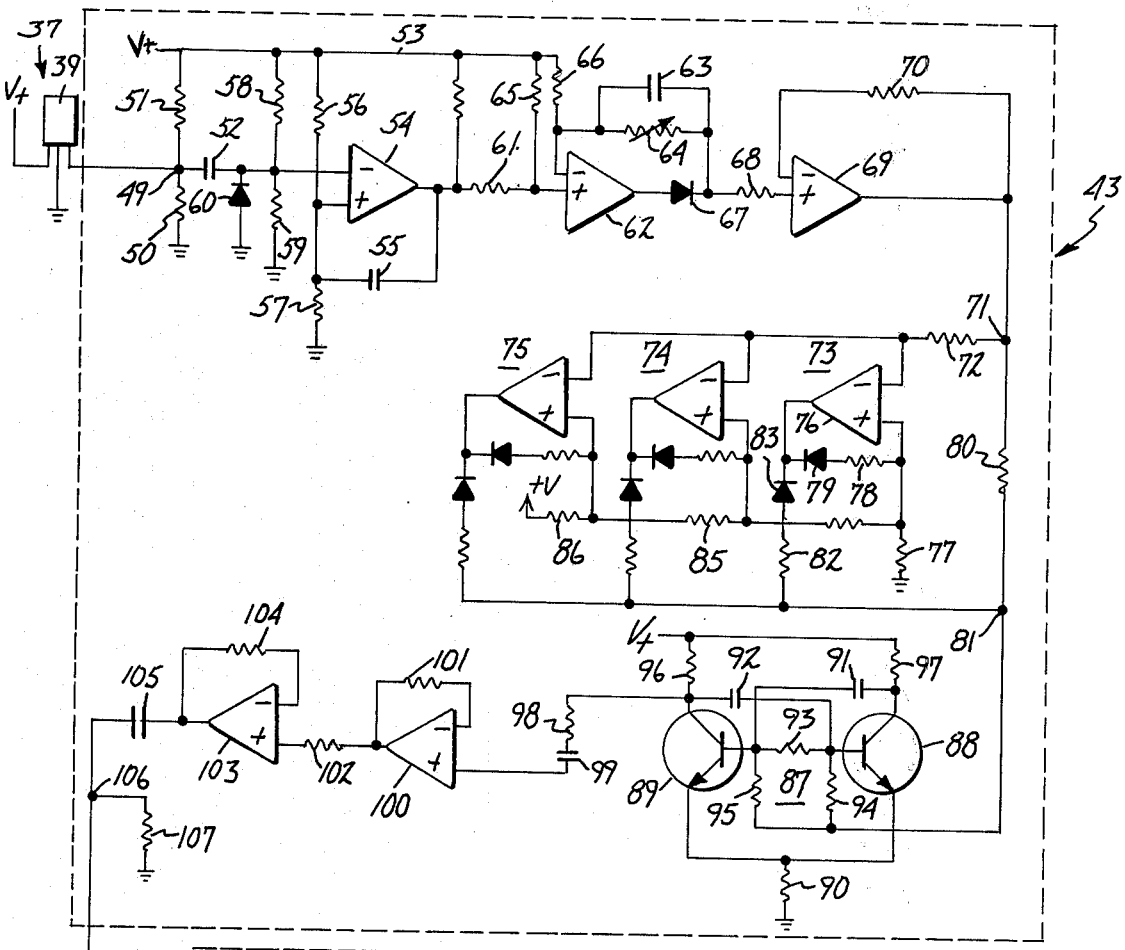
FIG. 5 is an electrical circuit diagram of the digital signal sensor, signal converting circuit, and transmitter of the sound simulator of FIG. 3.
Figure 5:
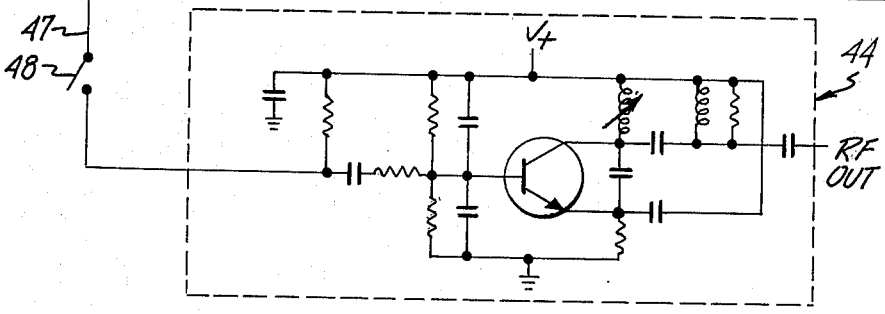

Referring then to FIG. 5, signals picked up by the Hall-Effect sensor 39 are applied to a junction point 49 between a first resistor 50, a second resistor 51 and a capacitor 52. Resistor 50 has its other terminal connected to ground while the remaining terminal of resistor 51 is connected to a bus conductor 53. The remaining terminal of capacitor 52 is connected to the inverting input of an operational amplifier 54 which is configures to operate as a monostable multi-vibrator or one-shot circuit. That is to say, a feedback element in the form of a capacitor 55 is coupled between the output of operational amplifier 54 and the non-inverting input thereto. Bias is applied by way of a voltage divider including the series connected resistors 56 and 57 which are coupled between the bus conductor 53 and ground. Similarly, a suitable bias is applied to the inverting input of the operational amplifier 54 by way of the voltage divider comprised of series connected resistors 58 and 59 also connected between bus conductor 53 and ground. A diode 60, poled as shown, is connected between the inverting input of operational amplifier 54 and ground.

The output from the one-shot circuit, including operational amplifier 54 and its associated components, is direct coupled through a resistor 61 to the input of a digital-to-analog converter stage comprised of the operational amplifier 62. In this instance, the feedback elements associated with operational amplifier 62 are configured such that the combination functions as an integrating circuit. As such, a feedback capacitor 63 coupled in parallel with a variable resistor 64 is coupled between the output of operational amplifier 62 and its inverting input. Again, the requisite bias for operational amplifier 62 is derived from the voltage present on bus 53 via the coupling resistors 65 and 66, the resistor 65 being associated with the non-inverting input and the resistor 66 being associated with the inverting input.

A diode 67 is connected in series with a coupling resistor 68 and joins the output from the operational amplifier 62 to the non-inverting input of a further operational amplifier 69 which is configured to function as a non-inverting amplifier or buffer. In this regard, a feedback resistor 70 is coupled between the output of operational amplifier 69 and its inverting input.

The output from the buffer amplifier appears at a junction 71 and is coupled through a first resistor 72 to a string of comparators 73, 74 and 75. In that each is substantially identically configured, it is deemed necessary to only describe one such comparator stage in detail, the others being alike except for the component values selected for establishing the desired comparison thresholds for each stage. With the foregoing in mind, then, and with reference to comparator stage 73, it can be seen to include an operational amplifier 76 having its inverting input coupled to the remaining terminal of resistor 72 and its non-inverting input coupled through a resistor 77 to ground. The feedback circuit for the comparator 73 comprises a series connection of a resistor 78 and a diode 79 which join the output of operational amplifier 76 to its non-inverting input. This feedback path, and therefore the threshold, of operational amplifier 76 is also determined by a further resistor 80 having one terminal thereof coupled to the junction point 71 and its remaining terminal coupled to a junction 81 to which is joined one side of a resistor 82. The other terminal of the resistor 82 is coupled through a further diode 83 to the output point of operational amplifier 76. Bias for the non-inverting input of the comparators 73, 74 and 75 is obtained from appropriate points on a voltage divider including the resistor 77 and the series connected resistors 84, 85 and 86 which connects to a source of positive potential +V.

The outputs from the three comparators 73, 74 and 75 are OR'ed together at the junction point 81 and the resulting signal is coupled to a voltage controlled astable multi-vibrator indicated generally by numeral 87. This multi-vibrator is of a standard configuration and includes a pair of NPN transistors 88 and 89 each of which has its emitter electrode coupled through a resistor 90 to ground and its collector coupled through a capacitor 91–92 to the base electrode of the other transistor. A resistor 93 is coupled between the base electrodes of the two transistors and resistors 94 and 95, respectively, couple the junction point 81 to the base electrodes of the transistors 88 and 89. The operating voltage for the multi-vibrator 87 is obtained from a source of positive potential V+ via load resistors 96 and 97.

The output pulses from the voltage controlled astable multi-vibrator 87 are coupled through a series combination of a resistor 98 and a capacitor 99 to the non-inverting input of an operational amplifier 100 which has a feedback resistor 101 coupled between its output and its inverting input. As such, the operational amplifier 100 functions as a buffer amplifier and its output is direct coupled via a resistor 102 to the non-inverting input of a further buffer amplifier including an operational amplifier 103 and its feedback resistor 104.

The output from this last-mentioned buffer amplifier is capacitively coupled via capacitor 105 to a junction point 106 on the conductor 47. A resistor 107 joins that junction point 106 in ground. The combination of the capacitor 105 and the resistor 107 operate as a differentiator to effectively differentiate the output signals emanating from the buffer amplifier 103. The voltage signals appearing on the conductor 47 may be selectively applied through a single pole, single throw on/off switch 48 to the input of the transmitter 44. The transmitter merely comprises a single-stage, low-power FM circuit of conventional design. It has an adjustable center-frequency in the range of from 88 to 100 MHz such that its RF output signal is compatible with standard FM receivers. Thus, small, portable AM/FM radios in common usage may be utilized as the receivers 14 and 16. If desired, an amplitude-modulated transmitter suitable for use in the AM broadcast band may be utilized in place of the RF transmitter 44 in carrying out the invention.

Having described the details of the construction of the on-board engine noise simulator, consideration will be given to its mode of operation.

With continued reference to FIG. 5, a change in state at the output of the Hall-Effect device 39 occurs as magnets 38 pass sensor element 39 and, as such, the signal output therefrom is proportional to the speed at which the vehicle is being driven. The sensor output is coupled through the capacitor 52 to the inverting input of the operational amplifier 54. As has already been explained, the operational amplifier 54 is configured to function as a monostable multi-vibrator or one-shot circuit such that the pulses emanating from the Hall-Effect sensor device are shaped to a uniform width and amplitude irrespective of input frequency.

The output from the monostable multi-vibrator is directly coupled via the resistor 61 to the non-inverting input of the operational amplifier 62 which is configured to function as an integrator circuit which averages the incoming pulses to produce a D.C. voltage level which is proportional in amplitude to the frequency of the incoming signals. Component values are chosen such that there is a compromise drawn between circuit hysteresis and the ripple component at the output of the integrator stage by judicious selection of the ohmic values of resistors 64 and 68 and the capacitance value of the capacitor 63. The variable resistor 64 can be used to set the amount of increase in D.C. level for each received input pulse and is thus adjustable to permit a full voltage range at the output of the integrator stage comprised of the operational amplifier 62 in accordance with the range of input pulse rates available from a particular vehicle model performance capability.

The output from the integrator stage is coupled through the resistor 68 to the buffer amplifier including operational amplifier 69 and its feedback component, resistor 70. The buffered output then becomes available at the junction point 71 between the coupling resistors 72 and 80.

The output from the buffer amplifier 69 is applied through the resistor 72 to the inverting inputs of the three comparator stages 73, 74 and 75. For reasons which will become apparent as the discussion proceeds, these comparators may be referred to as "gearshift latches" in that they are used to influence the frequency of the voltage-controlled astable multi-vibrator 87 in such a way as to simulate the internal combustion engine pitch change exhibited when a driver shifts gears in a race car.

As can be seen, the non-inverting input of each of the comparator stages 73 through 75 is held at a bias level which is primarily determined by the resistor network comprised of resistors 84, 85, 86 and 77. As the D.C. level at the output of the buffer amplifier stage 69 increases due to an increase in the frequency of received pulses (an increase in vehicle speed), pre-established thresholds are reached where the shift control voltage appearing at the junction 71 exceeds a particular pre-established bias voltage. When the threshold is exceeded, a change in state appears at the output of the respective one of the comparators 73 through 75. The resulting output from that particular comparator is coupled back to its respective non-inverting input via selected values of the resistances to thereby reduce the bias voltage for that comparator. The resulting change in the input bias avoids "gear searching" which may occur if the model racer is operating at a relatively constant speed at a borderline shifting point. In addition, it adds an element of variety to up-shift and down-shift speeds as would be expected in a manually-shifted full-size race car.

As the output of the buffer amplifier 69 decreases due to a slowdown of the vehicle speed, a point is reached where the new bias level will predominate and the output of the respective comparator will revert back to its "off" state. Thus, one may select the component values associated with the thresholding of the comparators such that comparator 73 simulates a shifting from first gear to second gear, comparator 74 simulates the shifting from second to third while comparator 75 corresponds to a shifting from third gear to fourth gear.

The voltage-controlled astable multi-vibrator 87 derives its control voltage from the output of the buffer amplifier 69 via coupling resistor 80. However, the actual voltage presented at the input to the multi-vibrator 87 is a function of the resistance ratio of resistor 80 to the total loading at the junction point between resistor 80, resistor 94 and resistor 95. The loading is the result of one or more of comparators 73 through 75 changing states, the resulting "low" signal being resistively coupled to the multi-vibrator input via the resistor 82 or the corresponding resistors associated with comparator stages 74 and 75. In the second gear speed range, only comparator 73 changes state. In the third gear speed range, the outputs of both comparators 73 and 74 are low. All outputs of comparators 73 through 75 load the input to the multi-vibrator in the fourth gear speed range. The just-mentioned resistance ratio effectively alters the output frequency of the multi-vibrator in much the same way that different "gear ratios" in the transmission of a full-size race car have an effect on its engine's revolution rate. The ohmic values of the resistor 82 and the corresponding resistors associated with stages 74 and 75 are chosen as complements to the selected shift points set by comparator bias levels.

The output from the voltage controlled astable multi-vibrator 87 is capacitively coupled via capacitor 99 to the operational amplifiers 100 and 103 which provide buffering and shaping of the multi-vibrator output. The R/C differentiating circuit comprised of the resistor 107 and the capacitor 105 is included to present a "raspy" audio character to the input of the transmitter module 44. It is found that this enhances the realism of the resulting received and amplified audio signal.

The AM/FM receivers 14 and 16 have circuits that produce signals that automatically adjust the sound output levels in response to the distance between the transmitter on the car and the receivers located adjacent the track 10. As this distance changes, the sound level from the receivers change. The closer the car is to a receiver, the higher the sound level of the receiver. D.C. feedback is employed in the RF and IF sections of a radio receiver to compensate for variations in received signal strength. This feedback is used to control audio stages, as well as the RF and IF sections. Noise and distortion free audio is maintained. Only the loudness level is affected in a purposed relation to increasing or decreasing signal strength with its associated change in feedback level. Conventional electrical components, as resistors, an amplifier, and transistors are used with an AM/FM radio to provide the receiver that has a variable sound output.

While there is shown and described an embodiment of the invention, it is understood that changes in materials, circuits, and parts may be made by one skilled in the art without departing from the invention. The invention is defined in the following Claims.

The embodiments of the invention in which an exclusive property or privilege is claimed are defined as follows:

1. An engine sound simulating apparatus for a vehicle having drive means powered by an electric motor to propel the vehicle in a desired path, said drive means having a rotatable member that rotates in direct proportion to the speed of the vehicle comprising: digital switch sensor means responsive to the speed of rotation of the rotatable member for producing an output signal having a frequency proportional to the speed of the vehicle, signal converting means for receiving said output signal and converting said signal to a signal having a frequency that changes in response to ranges of speed of the vehicle, transmitter means connected to the signal converting means to transmit signals from the signal converting means, a plurality of receiver means located adjacent the path along which the vehicle is propelled for receiving the transmitted signals, said receiver means having speaker means providing an audio output simulating the operation of an engine powering the vehicle.

2. The apparatus of claim 1 wherein: the digital switch sensor means includes magnet means mounted on the rotatable member, said magnet means moving in a circular path on rotation of the rotatable member, and a sensor element located adjacent a portion of the circular path, said sensor element operable to provide said output signal each time the magnet means passes through said portion of the circular path.

3. The apparatus of claim 1 wherein: said drive means includes a first gear connected to said electric motor, and said rotatable member includes a second gear driven by the first gear, said digital switch sensor means includes magnet means mounted on the second gear and rotatble therewith, and a sensor element located adjacent said second gear operable to provide said output signal each time the magnet means passes adjacent the sensor element.

4. The apparatus of claim 2 or 3 wherein: said magnet means includes a plurality of permanent magnets.

5. The apparatus of claim 1 wherein: the digital switch sensor means includes a permanent magnet having a magnetic force field attached to the rotatable member and movable therewith, and means located adjacent said rotatable member operable to provide said output signal in response to movement of said permanent magnet.

6. The apparatus of claim 1 wherein: said signal converting means has a plurality of comparators and a multi-vibrator coupled to the comparators, each of said comparators being responsive to a separate frequency range of said output signal derived from the digital switch sensor means to alter the output frequency of the multi-vibrator to simulate different speed ranges of the engine in which sound is simulated.

7. The apparatus of claim 1 wherein: said signal converting means has first means responsive to separate frequency ranges of the output signal from the digital switch sensor means, and second means connected to said first means having an output frequency that is altered by the signals from the first means to simulate different speed ranges of the engine in which sound is simulated.

8. The apparatus of claim 1 wherein: the digital switch sensor means includes magnet means mounted on the rotatable member for rotation therewith, a sensor element located adjacent said rotatable member operable to provide said output signals each time the magnet means moves past the sensor element, said signal converting means having a plurality of comparators and a multi-vibrator coupled to the comparators, each of said comparators being responsive to a separate frequency range of said output signals derived from the sensor element to alter the output frequency of the multi-vibrator to simulate different speed ranges of the engine in which sound is simulated.

9. An engine sound simulating apparatus comprising: a vehicle having at least one drive wheel, an electric motor, a source of electric power, control means operably connecting the source of electric power to the electric motor to operate the motor, power transmitting means connecting the drive wheel and electric motor whereby on operation of the electric motor the drive wheel rotates to move the vehicle on a support surface in a desired path, said power transmitting means having a member rotatable in proportion to the speed of the vehicle, an internal combustion engine sound simulating means responsive to the speed of rotation of the member to transmit signals, receiver means located adjacent the path along which the vehicle is moved for receiving the transmitted signals, said receiver means having speaker means providing an audio output simulating the operation of an internal combustion engine powering the vehicle.

10. The apparatus of claim 9 wherein: said internal combustion engine sound simulating means includes digital switch sensor means responsive to the speed of rotation of the member for producing an output signal having a frequency proportional to the speed of the vehicle, signal converting means for receiving said output signal and converting said signal to a signal having a frequency that changes in response to ranges of speed of the vehicle, and transmitter means connected to the signal converting means for transmitting the signals from the signal converting means to said remote located receivers.

11. The apparatus of claim 10 wherein: the digital switch sensor means includes magnet means mounted on said member, and a sensor element located adjacent said member, said sensor element operable to provide said output signal each time the magnet means moves past the sensor element.

12. The apparatus of claim 10 wherein: the digital switch sensor means includes a permanent magnet attached to the member and rotatable therewith, and means located adjacent said member operable to provide said output signal in response to rotation of said member.

13. The apparatus of claim 9 wherein: said power transmitting means includes a first gear connected to the electric motor, said member includes a second gear driven by the first gear, said digital switch sensor means includes magnet means mounted on the second gear and rotatable therewith, and a sensor element located adjacent said second gear operable to provide said output signal each time the magnet means moves past the sensor element.

14. The apparatus of claim 13 wherein: said magnet means comprises a permanent magnet attached to said second gear.

15. The apparatus of claim 9 wherein: said signal converting means has a plurality of comparators and a multi-vibrator coupled to the comparators, each of said comparators being responsive to a separate frequency range of said output signal derived from the digital switch sensor means to alter the output frequency of the multi-vibrator to simulate different speed ranges of the internal combustion engine.

16. The apparatus of claim 9 wherein: said signal converting means has first means responsive to separate frequency ranges of the output signal from the digital switch sensor means, and second means connected to said first means having an output frequency that is altered by the signals from the first means to simulate different speed ranges of the internal combustion engine.

17. The apparatus of claim 9 wherein: the digital switch sensor means includes magnet means mounted on the member for rotation therewith, a sensor element located adjacent said member operable to provide said output signals each time the magnet means moves past the sensor element, said signal converting means having a plurality of comparators and a multi-vibrator coupled to the comparators, each of said comparators being responsive to a separate frequency range of said output signals derived from the sensor element to alter the output frequency of the multi-vibrator to simulate different speed ranges of the engine in which sound is simulated.

18. In combination, an endless track having a surface, a vehicle having wheels engageable with said surface, said vehicle having an electric motor, power means drivably connecting said motor to at least one of said wheels, a source of electric power, and control means operably connecting the source of electric power to the electric motor to operate said motor and thereby driving said one of said wheels to move the vehicle around said endless track, a remote control operated means operable to effect steering of said vehicle and operation of said control means, an internal combustion engine sound simulating means responsive to the speed of operation of said electric motor to transmit signals of varying frequencies corresponding to speed ranges of said motor, a plurality of receiver means spaced about said endless track for receiving said transmitted signals, said receiver means having speaker means providing an audio output simulating the operation of an internal combustion engine powering the vehicle.

19. The combination of claim 18 wherein: said endless track has opposite portions, said receiver means being located adjacent said opposite portion of the track.

20. The combination of claim 18 wherein: said internal combustion engine sound simulating means includes digital switch sensor means responsive to the speed of the electric motor for producing an output signal having a frequency proportional to the speed of the vehicle moving on said track, signal converting means for receiving said output signal and converting said signal to a signal having a frequency that changes in response to ranges of speed of the vehicle, and transmitter means connected to the signal converting means for transmitting the signals from the signal converting means to said receiver means.

21. The combination of claim 20 wherein: the digital switch sensor means includes magnet means movable in response to operation of said electric motor, and a sensor element located adjacent said magnet means, said sensor element operable to provide said output signal each time the magnet means moves past the sensor element.

22. The combination of claim 20 wherein: said power transmitting means includes a first gear connected to the electric motor, a second gear driven by the first gear, said digital switch sensor means includes magnet means mounted on the second gear and rotatable therewith, and a sensor element located adjacent said second gear operable to provide said output signal each time the magnet means moves past the sensor element.

23. The combination of claim 22 wherein: said magnet means comprises a permanent magnet attached to the second gear.

24. The combination of claim 20 wherein: said signal converting means has a plurality of comparators and multi-vibrator coupled to the comparators, each of said comparators being responsive to a separate frequency range of said output signals derived from the digital switch sensor means to alter the output frequency of the multi-vibrator to simulate different ranges of speed of the internal combustion engine.

* * * * *